US005281352A

United States Patent [19]

Savio et al.

[11] Patent Number: 5,281,352

[45] Date of Patent: * Jan. 25, 1994

[54] LOW-PHOSPHATE MACHINE DISHWASHING DETERGENTS

[75] Inventors: Lenore E. Savio, Somerset; Raymond S. Brown, Bridgewater, both of N.J.

[73] Assignee: Church & Dwight Co., Inc., Princeton, N.J.

[ * ] Notice: The portion of the term of this patent subsequent to Oct. 6, 2009 has been disclaimed.

[21] Appl. No.: 937,523

[22] Filed: Aug. 27, 1992

[51] Int. Cl.[5] ..... C11D 3/37; C11D 7/12; C11D 7/14; C11D 7/56

[52] U.S. Cl. ..... 252/99; 252/95; 252/135; 252/174.14; 252/174.19; 252/174.24; 252/DIG. 2; 252/DIG. 11

[58] Field of Search ..... 252/95, 174.14, 174.24, 252/DIG. 2, 174.19, 135, 99

[56] References Cited

U.S. PATENT DOCUMENTS

| | | | |
|---|---|---|---|
| 3,888,781 | 6/1975 | Kingry | 252/99 |
| 3,954,500 | 5/1976 | Brown | 134/25 |
| 4,079,015 | 3/1978 | Paucot | 252/95 |
| 4,101,457 | 7/1978 | Place | 252/559 |
| 4,187,190 | 2/1980 | McLaughlin | 252/99 |
| 4,203,858 | 5/1980 | Chakrabarti | 252/135 |
| 4,379,069 | 5/1983 | Rapisarda | 252/135 |
| 4,608,188 | 8/1986 | Parker | 252/99 |
| 5,133,892 | 7/1992 | Chun | 252/90 |
| 5,152,910 | 10/1992 | Savio | 252/95 |

FOREIGN PATENT DOCUMENTS

| | | | |
|---|---|---|---|
| 3316513 | 11/1984 | Fed. Rep. of Germany | 252/174.24 |
| 2234980A | 2/1991 | United Kingdom | 252/174.24 |

*Primary Examiner*—Dennis L. Albrecht
*Attorney, Agent, or Firm*—Charles B. Barris

[57] ABSTRACT

The present invention is based upon the discovery that a low-phosphate automatic dishwashing composition comprising from about 2.0 to 50.0 percent by weight of alkali metal carbonate salts such that it contains a weight ratio of about 1:1 to 20:1 carbonate to bicarbonate, from about 2.0 to 60.0 percent by weight of a water-soluble organic complexing agent comprising one or more hydroxycarboxylic acids or the salts thereof, a sufficient amount of an alkaline condensed phosphate salt to provide from about 0.1 to 1.7 percent by weight of ($P_2O_5$) ion, from about 0.5 to 8.0 percent by weight of about a 2:1 to a 6:1 blend of an acrylic polymer comprising a salt or ester of acrylic or methacrylic acid having a molecular weight of between about 1,000 to 25,000, with a copolymer of a substituted or unsubstituted maleic anhydride and lower olefin having a molecular weight of from about 1,000 to 50,000, and from about 0.5 to 8.0 percent by weight of a nonionic surfactant provides satisfactory cleaning without unacceptable spotting and filming and without the need to add a chlorinated agent.

17 Claims, No Drawings

LOW-PHOSPHATE MACHINE DISHWASHING DETERGENTS

CROSS REFERENCE TO RELATED APPLICATIONS

The subject matter of the present patent application is related to that disclosed in U.S. Pat. No. 5,152,910, issued Oct. 6, 1993, U.S. Pat. No. 5,152,911, issued Oct. 6, 1993, and commonly assigned patent application Ser. No. 07/937,524 filed Aug. 27, 1992, concurrently herewith.

FIELD OF THE INVENTION

This invention relates to low-phosphate machine dishwashing compositions. More particularly, this invention relates to automatic machine dishwashing compositions which are extremely low in phosphorus, yet which more efficiently remove food soils with equivalent spotting and clarity to glassware and dishes as compared to conventional phosphate-built dishwashing compositions.

BACKGROUND OF THE INVENTION

In the detergent industry, distinctions are drawn between cleaning compositions on the basis of their functional utility. For example, there are considerable art-recognized differences between cleaning compositions that are used for laundering purposes; cleaning compositions that are used for machine dishwashing purposes; and cleaning compositions that are used for hand dishwashing purposes. Generally, cleaning compositions for laundering purposes employ high foaming organic surfactants as the main cleansing agents. Foaming, unless it is excessive to the extent that it causes overflow from the washing machines, is generally considered beneficial in laundering compositions because it provides an indication to users that the product is working. By way of contrast, machine dishwashing methods which are currently used to wash china, glass, porcelain, ceramic, metal, and hard synthetic articles impart a high mechanical impact of the wash liquid which is sprayed onto the articles to be cleaned. Recently, developments in dishwashing apparatus have been directed toward further increasing the intensity of liquid motion as well as the water volume cycled per minute, so as to further improve the mechanical cleansing effect of the cleansing solution. Compared to laundering compositions, however, machine dishwashing compositions are very low-foaming compositions inasmuch as foam formation interferes with the mechanical action of the dishwasher and reduces the mechanical impact of the liquid sprayed onto the articles to be cleaned. The surface active agents useful for machine dishwashing compositions should not only be low foaming materials, but they should also be foam depressants, so that the foaming caused by protein and food residues in combination with alkaline cleansing solutions is kept to a minimum. This situation, however, is quite different from hand dishwashing compositions, which, preferably, are high foaming and have more the attributes of laundering compositions.

Thus, machine dishwashing detergents constitute a generally recognized class of detergent compositions. In summary, machine dishwashing detergents are mixtures of ingredients whose purpose, in combination, is to emulsify and remove food soils; to inhibit the foam caused by certain food soils; to promote the wetting of dinnerware to thereby minimize or eliminate visually observable spotting; to remove stains such as those caused by coffee and tea; to prevent a buildup of soil films on dinnerware surfaces; and to reduce or eliminate tarnishing of flatware. Additionally, machine dishwashing detergents must possess these characteristics without substantially etching or corroding or otherwise damaging the surface of dinnerware and flatware.

It is conventional to use strongly alkaline solutions in institutional and household dishwashing machines for washing dishes, glasses, and other cooking and eating utensils. Ordinary tap water is used to make up the strongly alkaline cleaning solution and for rinsing purposes subsequent to the cleaning operation. However, spotting on dishes and glassware by hard water and soil residues and precipitates has been a major problem. Currently these problems are minimized in machine dishwashing detergent compositions by the use of relatively high levels of polyphosphates to act as hardness sequestering agents, thus reducing the amount of hard-water deposits and filming on glassware. In addition, these detergents usually contain a chlorine bleaching system for stain removal and an added cleaning boost by oxidizing protienacious soils on glassware. Chlorinating agents also help prevent spotting.

Although the performance of these conventional detergent compositions are quite satisfactory, high phosphate levels have potential environmental drawbacks. Furthermore, the addition of chlorine bleach requires special processing and storage and packaging precautions. Additionally, chlorine bleach imparts an undesirable odor and makes fragrancing the finished product more difficult.

In recent years, increased attention has been focused upon environmental pollution problems (e.g. water pollution). Phosphates have been identified as a contributing factor to eutrophication (i.e. promotion of algae growth) and considerable effort has been devoted to attempts at replacing all or at least some significant part of the alkaline condensed phosphates used in machine dishwashing detergents with chemicals that are more ecologically acceptable. Of the numerous compounds that have been tested as substitutes for alkaline condensed phosphates (particularly as substitutes for sodium tripolyphosphate), very few chemicals have given promising results. Many chemicals lack the desired cleaning ability. Other chemicals lack the building effect of the polyphosphates which promote cleaning even when used at levels lower than that required to sequester all the hard water metal ions present. Still others are as much or more ecologically undesirable and are too expensive to be practical.

It is not conventional to replace the condensed polyphosphates in dishwashing detergents with carbonate salts. Although carbonate salts are effective and economical water softeners, they remove water hardness ions by precipitation and as a result leave unacceptable levels of residue on the dishes, glassware and utensils being washed.

It is desirable, therefore, to provide a moderately alkaline, low-phosphate, non-chlorine automatic dishwashing detergent composition which provides excellent glassware spotting and filming results. It is especially desirable to provide a detergent composition which imparts glassware cleaning efficacy equal to that of conventional automatic dishwashing detergents which rely on high levels of phosphates and chlorine bleach to achieve the same results. It would also be desirable to provide a stable, less alkaline detergent composition which requires no expensive barrier packaging for extended shelf-life stability.

SUMMARY OF THE INVENTION

The present invention is based upon the discovery that high levels of carbonate salts and water-soluble organic complexing agents can be formulated with minor concentrations of phosphates (e.g., about 0.1 to 1.7 percent by weight as expressed as ($P_2O_5$) ion) together with low levels of a mixture of certain polycarboxylate homopolymers and copolymers (i.e., in combination, a total of about 0.5 to 8.0 percent by weight), and relatively high levels of nonionic surfactants in a dishwashing detergent formulation while providing satisfactory cleaning without unacceptable spotting and filming and without the need to add a chlorinating agent.

Accordingly, the present invention provides improved automatic dishwasher detergents comprising from about 2.0 to 50.0 and, preferably, about 5.0 to 40.0 percent by weight of alkali metal carbonates wherein said carbonates comprise a weight ratio of between about 1:1 to 20:1 carbonate to bicarbonate; from about 0.1 to 1.7, preferably, from about 0.3 to 1.2 percent by weight (based on ($P_2O_5$) ion content) of alkaline condensed phosphate salts; and, one or more water-soluble organic complexing or sequestering agents for calcium which are used as a phosphate substitute and include, for example, carboxylic and polycarboxylic acids, hydroxycarboxylic acids, aminocarboxylic acids, carboxyalkyl ethers and polyanionic polymeric carboxylic acids, these compounds generally being used in the form of their water-soluble salts. The salts of citric acid are preferred. Such water-soluble organic complexing or sequestering agents are used in amounts of from about 2.0 to 60.0 percent by weight and, preferably, in an amount of from about 5.0 to 45.0 percent by weight based on the total weight of the detergent formulation.

In accordance with the invention from about 0.5 to 8.0 and, preferably, about 3.0 to 7.0 percent by weight of a blend of polymers comprising an acrylic homopolymer having a molecular weight of between about 500 to 1,000,000 or more depending on the degree of crosslinking and a copolymer derived from a substituted or unsubstituted maleic anhydride and a lower olefin in place of all or a portion of the cyclic anhydride having a molecular weight of between about 500 to 1,000,000 or more depending on the degree of crosslinking, wherein the weight ratio of acrylate homopolymer to maleic/olefin copolymer is between about 2:1 to 6:1 and, preferably, is about 3:1 and wherein the maleic/olefin copolymer is employed in amounts of no greater than about 1.5 percent by weight, and from about 0.5 to 8.0 percent and, preferably, about 1.0 to 5.0 percent by weight of a foam-suppressing nonionic surfactant.

While removal of phosphates from conventional dishwashing detergents containing approximately 20 to 30 percent by weight carbonate has not been practical due to severe spotting and filming, surprisingly, we have found that virtually all of the phosphate can be removed if the above mentioned water-soluble organic complexing agents and polymer system are added to the formulation. Indeed, the total level of carbonate can be increased to levels not normally used and yet with significantly reduced spotting and filming normally encountered with carbonate formulations and in some instances improve performance even to the levels seen with high phosphate formulas.

DETAILED DESCRIPTION OF THE INVENTION

Automatic dishwashing detergents ("ADDs") of the present invention are generally formulated as solid detergents. Although the present invention can be applied to or embodied in various types of machine dishwashing detergents, its greatest advantage is associated with the production of powdered or granular compositions.

The machine dishwashing detergent compositions of the present invention will normally contain at least one alkali metal carbonate salt, a water-soluble organic complexing agent, an alkaline condensed phosphate salt, a polymer system as described above, and a nonionic foam-suppressing surfactant. However, we have found that in addition to these agents, performance improvements are achieved by the addition of relatively low levels of a peroxygen bleach in amounts up to about 10.0 percent by weight. These non-chlorine oxidizing agents can be employed with or without activators to improve efficacy. Examples of such oxidizing agents are perborates, percarbonates, persulfates, and the like.

In use, the amount of detergent composition added to the wash water will preferably be limited so that the dissolved solids of the composition do not exceed about 1 percent by weight of the wash water, the preferred concentration in the wash water being about 0.25 to 0.75 percent by weight. Concentrations of less than about 0.5 percent by weight are typically sufficient for good automatic machine dishwashing.

All the ingredients of this invention should be selected so as to provide a detergent which produces little or no foam during machine dishwashing, even in interaction with foamable food soils. Low-foaming or non-foaming ingredients can be used to help provide this freedom from excessive foaming, and, as will be pointed out in more detail subsequently, surfactants with low foaming or even de-foaming properties are added to reduce or control foaming.

The alkaline carbonate salt may be an alkali metal carbonate. Typical of the alkali metal carbonates which can be employed in the compositions of the present invention are the alkali metal carbonates; bicarbonates; sesquicarbonates; and mixtures thereof. Illustrative of such carbonates are lithium carbonate, sodium carbonate, potassium carbonate, ammonium carbonate, sodium bicarbonate, ammonium bicarbonate, potassium bicarbonate, sodium sesquicarbonate, and mixtures thereof.

Surprisingly, it has been found that when these carbonate salts are used in compositions of the invention they do not leave undesirable amounts of precipitates on the surface of the articles being washed. These alkali metal carbonate salts are used in amounts of from about 2.0 to 50.0 and, preferably, about 5.0 to 40.0 percent by weight based on the total formulation. It has been found that a ratio of 1:1 to 20:1 and, preferably, 4:1 to 10:1 carbonate to bicarbonate moiety provides adequate cleaning without excessive spotting or filming. The pH of these formulations will be in the alkaline 9.0 to 11.0 pH range.

In accordance with the present invention, one or more water-soluble organic complexing or sequestering agents for calcium may also be used as a phosphate substitute and include, for example, carboxylic and polycarboxylic acids, hydroxycarboxylic acids, aminocarboxylic acids, carboxyalkyl ethers and polyanionic polymeric carboxylic acids, these compounds generally being used in the form of their water-soluble salts.

Examples of such salts include, by way of example, the alkali metal polyacetates, carboxylates, polycarboxylates, and polyhydroxysulfonates. Specific examples of the polyacetate and polycarboxylate chelating salts include the sodium and potassium salts of ethylene diamine tetraacetic acid, nitrilotriacetic acid, oxydisuccinic acid, carboxymethyloxysuccinic acid, carboxymethyl tartronic acid, polyacrylic acid, poly-a-hydroxyacrylic acid, carboxymethyl malic acid, mellitic acid, benzene polycarboxylic acids, and citric acid.

Hydroxycarboxylic acids and the salts thereof are preferred with the salts of citric acid, that is, sodium citrate, potassium citrate, or mixtures thereof, being especially preferred.

The water-soluble organic complexing or sequestering agents are used in amounts of from about 2.0 to 60.0 percent by weight and, preferably, in an amount of from about 5.0 to 45.0 percent by weight based on the total weight of the detergent formulation.

The alkaline condensed phosphate salts used herein are also well known to those engaged in the detergent industry. The alkaline condensed phosphate salt may be any alkaline condensed phosphate salt but are preferably sodium or potassium tripolyphosphate, hexametaphosphate, pyrophosphate or glassy phosphate salts.

Especially preferred is a technical grade sodium tripolyphosphate which has a typical analysis of 57 percent by weight of ($P_2O_5$) ion and a molecular weight of 367.9 which is manufactured and sold by FMC Corporation. Also especially preferred is a glassy sodium hexametaphosphate which has a typical analysis of 68.9 percent by weight of ($P_2O_5$) ion which is manufactured by FMC Corporation and sold under the trademark of "Glass H".

According to the present invention alkaline condensed phosphate salts are used in amounts to provide from about 0.1 to 1.7 percent and, preferably, from about 0.3 to 1.2 percent by weight of ($P_2O_5$) ion. Thus, sodium tripolyphosphate would be employed in amounts of from about 0.2 to 3.0 percent and, preferably, from about 0.5 to 2.1 percent by weight to supply the desired amount of ($P_2O_5$) ion.

The dispersants utilized in the present invention are blends of water soluble salts of particular polyelectrolytes. Broadly, one group of the polyelectrolytes encompassed comprise homopolymers or copolymers of acrylic acid, methacrylic acid, maleic acid, fumaric acid, itaconic acid, and the like. The polyelectrolyte may be polyacrylic acid, polymethacrylic acid, or a copolymer of acrylic and methacrylic acids, said homopolymer or copolymer and range in molecular weight from about 500 up to about 1,000,000 depending on the degree of crosslinking.

Particularly suitable water soluble organic polymers for use in this invention are homopolymers prepared from a monomer having the general formula:

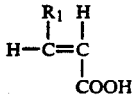

where $R_1$ is a hydrogen atom or methyl radical. While the tern homopolymer is used, it is intended that it includes by definition polymers that contain small, i.e., about 10 mole percent or less, quantities of one or more comonomers.

While the preparation of polyacrylates from acrylic acid and methacrylic acid monomers is well known in the art and need not be detailed here, the following will illustrate the general technique that can be used.

The polymerization of acrylic acid to polyacrylate acid can be stopped at any appropriate molecular weight (determined by viscosity). The conditions under which it is polymerized will result in different performance characteristics for similar molecular weight polymers. If, for example, the polymerization took place under a condition of a high temperature (100°-150° C.), there will be a strong tendency for crosslinking to occur. Crosslinking is undesirable as it decreases the apparent acid strength of the polyacid by preventing the expansion of the molecules, which would otherwise increase the separation between carboxylic groups. This results in two distinct adverse effects. First, the solubility of the polymer is reduced and, second, the chelation ability is reduced. It should be noted that the higher the molecular weight, the more likely extensive crosslinking occurs. It is, however, possible to produce polyacrylic acid having molecular weights in the millions without extensive crosslinking by reacting the monomers under very mild conditions.

Water soluble salts of acrylic acid and methacrylic acid homopolymers as described above are especially preferred for the purposes of the invention. The water-soluble salt can be an alkali metal, ammonium or substituted (quaternary) ammonium salt. The alkali metal can be sodium or potassium. The sodium salt is preferred. The salt can be used in a partially or fully neutralized form. Also, partial neutralization and esterification of the carboxylic acid groups can be carried out while still retaining the effective properties of the homopolymer. The homopolymers are converted to the desired salt by reaction with the appropriate base, generally with a stoichiometric excess of the desired percent of conversion. Normally 100 percent of the carboxyl groups present will be converted to the salt, but the percentage can be less in certain situations. In general, the homopolymers of the invention in the acid form before conversion to a salt or ester, will have a molecular weight (Staudinger) of from about 500 to 1,000,000, preferably about 1,000 to 25,000, even more preferably, about 2,000 to 10,000 and, most preferably, about 4,500.

A particularly preferred water soluble polymer is ACUSOL 445ND dispersant which is a sodium salt of polyacrylic acid having a molecular weight of about 4,500 and manufactured and sold by Rohm & Haas Company.

According to the present invention, the addition of a maleic/olefin copolymer to the acrylic acid homopolymer or the like has been found, surprisingly, to enhance performance, i.e., reduce undesirable filming and spotting.

Such second moiety of the polymeric blend preferably comprises a copolymer derived from a substituted or unsubstituted maleic anhydride and a lower olefin in place of all or a portion of the cyclic anhydride. The copolymer contributes to the ability of the present automatic dishwasher detergent to dry to a clear, film-free surface. Preferably, the maleic anhydride monomer is of the formula:

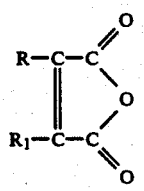

where R and $R_1$ are independently H, $(C_1-C_4)$alkyl, phenyl, $C_1-C_4)$alkylphenyl, or phenyl$(C_1-C_4)$alkylene; most preferably R and $R_1$ are H. The lower olefin component is preferably a $(C_2-C_4)$olefin, e.g., ethylene, propylene, isopropylene, butylene, or isobutylene; and most preferably is ethylene. The copolymers may vary in molecular weight (Staudinger), e.g., from about 500 to 1,000,000 or more. Preferred copolymers are those having a molecular weight, of about 1,000 to 50,000, since they are more effective in eliminating spotting. For example, ACUSOL 46OND dispersant (which is manufactured and sold by Rohm & Haas Company) has a molecular weight of about 15,000 and is a preferred component of the dispersant system of this invention.

The blend of such water soluble polymers is included in an amount from about 0.5 to about 8.0 percent by weight, and, preferably, in an amount from about 3.0 to about 7.0 percent by weight on an anhydrous basis. The weight ratio of polyacrylate or the like to maleic/olefin copolymer is between about 2:1 to 6:1, preferably, about 3:1 to 5:1 and is, most preferably, about 4:1. The total amount of the blend utilized and the ratio of the homopolymer to polymer is adjusted so that an amount of no greater than about 1.5 percent by weight of the maleic-/olefin copolymer is employed in the detergent composition.

Additional sequesterants could be added, for example the water-soluble salts of aliphatic hydroxypolycarboxylic acid sequesterants such as citric acid, cyclic aliphatic and aromatic polycarboxcylic acids such as cyclopentane tetracarboxylic acid, and salts of polycarboxcylic acids containing ether links, such as oxydiacetic acid, oxydisuccinic and carboxymethyloxysuccinic acid, and homologues and analogs of these compounds. "ETDA" (ethylenediamine tetraacetate), preferably, the tetra-sodium salt thereof, and its analogs can also be employed. While sodium nitrilotriacetate could be used, there are some questions regarding the environmental acceptability of this agent. Mixtures of two or more of these suitable sequestering agents may be used if desired. These compounds are usually used in water-soluble salt form, particularly as the alkali metal, for example, sodium salts, but it may be possible to use the sequesterants in acid form for neutralization in solution.

The low-phosphate machine dishwashing compositions of the present invention also include from about 0.5 percent to about 8.0 percent and, preferably, about 1.0 to 5.0 percent by weight of a foam-suppressing nonionic surfactant. Illustrative of such surfactants are the modified ethyoxylated alcohol or alkyl phenol type, wherein the ethoxylate is modified by replacing the terminal OH group with halogen, for example, chlorine, or alkoxy, or with aryloxy and arylalkyloxy groups; amine polyglycol condensates; pluronic-surfactants obtained by the condensation of ethylene oxide with hydrophobic bases formed by condensing propylene oxide with propylene gylcol, and the like.

Typical nonionic detergent active compounds which can be used in the compositions of the invention include ethoxylated fatty alcohols, preferably linear monohydric alcohols with $C_{10}-C_{18}$, preferably $C_{10}-C_{15}$, alkyl groups and about 5-15, preferably 7-12, ethylene oxide (EO) units per molecule and ethoxylated alkylphenols with $C_8-C_{16}$ alkyl groups preferably $C_8-C_9$ alkyl groups, and from about 4-12 EO units per molecule. Specific nonionic detergents which may be employed herein include, by way of example, Plurafac RA 40 and RA 30 (manufactured by BASF), which are linear alcohol alkoxylates with varying amounts of ethylene oxide and propylene oxide; Pluronic L61 (manufactured by BASF), which is a block copolymer with a molecular weight of 2000; Polytergent S305LF and S405LF (manufactured by Olin Chemical), which are alkoxylated linear alcohols similar to Plurafac RA 40 and RA 30; and Polytergent P-17A (manufactured by Olin Chemical), which is an ethoxylated polyoxypropylene glycol.

An especially preferred nonionic surfactant is an alkoxylated linear alcohol having the following composition:

$$RO-(CH_2\underset{\underset{R'}{|}}{C}HO)_x(CH_2-CH_2O)_y(CH_2\underset{\underset{R''}{|}}{C}HO)_z-H$$

wherein R is a $C_6-C_{10}$ linear alkyl mixture, R' and R'' are methyl, x averages 3, y averages 12 and z averages 16. Such an alkoxylated linear alcohol is sold by BASF under the trademark INDUSTROL DW 5, and is described in U.S. Pat. No. 4,464,281, column 5, lines 55 et seq.

The nonionic compounds may be used in admixture with minor amounts of other detergent-active compounds to improve their characteristics.

It is preferred to include bleaching agents in the present invention. The preferred bleaching agents employed are classified broadly as oxygen bleaches. Preferably chlorine bleaches are not utilized herein. The oxygen bleaches are represented by percompounds which are true per salts or ones which liberate hydrogen peroxide in solution. Preferred examples include sodium and potassium perphosphates, perborates, percarbonates, and monopersulfates. The perborates, particularly sodium perborate, are especially preferred.

The oxygen bleach is employed in amounts of from 0 to about 8.0, and preferably, from about 1.0 to 6.0 percent by weight of the detergent formulation.

The peroxygen bleach may be used in conjunction with an activator therefor. Polyacylated compounds may be used with perborates or other peroxygen bleaches as activators; tetraacetylethylenediamine ("TAED") is particularly preferred. Other useful activators include, for example, acetyl-salicylic acid derivatives, pentaacetyl glucose tetraacetylglycoluril ("TAGU"), ethylidene benzoate acetate and its salts, alkyl and alkenyl succinic anhydride, and the derivatives of these.

A useful bleaching composition containing peroxygen bleaches capable of yielding hydrogen peroxide in an aqueous solution and specific bleach activators at specific molar ratios of hydrogen peroxide to bleach activator is disclosed in Chung et al, U.S. Pat. No. 4,412,934 assigned to The Proctor & Gamble Company.

Corrosion inhibitors can be added if desired. Soluble silicates are highly effective inhibitors and can be added to certain formulas of this invention at levels of from about 5.0 percent to about 25.0 percent by weight. Alkali metal silicates, preferably, potassium or sodium silicates having a weight ratio of $SiO_2:M_2O$ of from about 1:1 to 2.8:1 can be used. M in this ratio refers to sodium or potassium. A sodium silicate having a ratio of $SiO_2:Na_2O$ of about 1.6:1 to 2.45:1 is especially preferred for economy and effectiveness.

In accordance with the present invention the machine dishwashing compositions can also optionally include up to about 60 percent by weight, preferably, about 5 to 55 percent by weight, of an inert diluent such as alkali metal sulfates, chlorides, nitrites, and the like. Illustrative of such diluents are sodium or potassium sulfate, sodium or potassium chloride, sodium or potassium nitrite and the like. Sodium sulfate is the preferred inert diluent herein.

Additionally, small amounts of conventional adjuvants such as perfumes, colorants, chlorinated bleaches, bacterial agents or other similar adjuvants can suitably be employed.

Such conventional additives are employed, generally in the amount of about 0 to 5.0, preferably 1.0 to 5.0 percent by weight. Such additives may also include aluminates and silicates for protection of the china, and foam suppressors.

Evidence of the effectiveness of the novel automatic dishwasher detergent compositions of the present invention is presented hereinafter with a view to providing illustrative compositions within the purview of the present invention. The person skilled in the art will readily appreciate that the specific embodiments in the following examples and illustrations are just that, illustrative and not unduly restrictive. Accordingly, the following examples further illustrate the machine dishwashing compositions and the dishwashing process of the present invention. Unless otherwise stated, all percentages and parts are by weight.

EXAMPLE I

A preferred composition of the present invention was tested for spotting and filming in order to illustrate its ability to retard or prevent formation of spots or film on glassware (tumblers), and utensils. The test procedure utilized was that defined in the Standard Method for "Deposition on Glassware During Mechanical Dishwashing" designated as ASTM-D3556-85. This test method covers a procedure for measuring performance of a mechanical dishwashing detergent in terms of the buildup of spots and film on glassware. It is designed to evaluate household automatic dishwasher detergents but can also be used as a screening test for institutional dishwashing products.

The following ingredients were processed in accordance with the method described hereinlater to produce the preferred embodiment of an automatic dishwasher detergent in accordance with the present invention.

| INGREDIENT | FUNCTION | WEIGHT PERCENT |
|---|---|---|
| Sodium Bicarbonate | Alkalinity | 5.00 |
| Sodium Carbonate (Soda Ash) | Builder, Alkalinity | 25.92 |
| Sodium Tripolyphosphate Hexahydrate) ($P_2O_5$)* | Builder, Sequestrant | 1.90 (1.08) |
| Accusol 445 ND | Polymer Dispersant | 4.30 |
| Accusol 460 ND | Polymer Dispersant | 1.10 |
| Industrol DW-5 (BASF) | Surfactant | 4.00 |
| Sodium Perborate Monohydrate | Oxygen Bleach | 5.00 |

-continued

| INGREDIENT | FUNCTION | WEIGHT PERCENT |
|---|---|---|
| (DuPont) Britesil H2O (Sodium Silicate) (PQ Corp.) | Corrosion Inhibitor | 20.00 |
| Sodium Citrate Dihydrate | Complexing Agent | 32.68 |
| Fragrance | Aesthetic | 0.10 |
| TOTAL | | 100.00 |

*Percent by weight expressed as ($P_2O_5$) ion.

The detergent composition was prepared as follows: The surfactant was initially mixed with the soda ash and the rest of the ingredients were dry blended with the above in a standard twin shell blender.

In order to comparatively test the preferred embodiment of this invention, it was subjected to a side by side evaluation with Cascade® Automatic Dishwasher Detergent which is manufactured by the Proctor & Gamble Company and is believed to have the following approximate formulation:

| INGREDIENT | WEIGHT PERCENT |
|---|---|
| Sodium Tripolyphosphate | 33.0 |
| Sodium Carbonate | 21.0 |
| Nonionic Surfactant | 2.0 |
| Sodium Silicate | 22.7 |
| ACL-59 (chlorinating agent) | 2.0 |
| Sodium Sulfate | 19.0 |
| Fragrance | 0.3 |
| TOTAL | 100.0 |

An evaluation of the preferred embodiment of this invention versus Cascade was made using extremely hard water. Hard water may be broadly defined as a water containing substantial quantities of calcium and magnesium ions on the order of approximately 100 parts per million (ppm) or more. Most municipal water supplies commonly considered hard contain 100 to 125 ppm. However, in some places, the water may contain 200 to 250 ppm. Hence, the evaluation of the preferred embodiment of this invention versus Cascade in 300 ppm hard water represented an extremely vigorous evaluation. The rating scale for filming and spotting was as follows:

| Rating | Spotting | Filming |
|---|---|---|
| 1 | No spots | None |
| 2 | Spots at random | Barely perceptible |
| 3 | About ¼ of surface covered | Slight |
| 4 | About ½ of surface covered | Moderate |
| 5 | Virtually completely covered | Heavy |

| | | Average Rating | | |
|---|---|---|---|---|
| | | Tumblers | | Utensils |
| | | Filming | Spotting | Filming |
| Cascade (45 g/cup) | Cycle 1 | 1.3 | 2.1 | 1.2 |
| | 2 | 1.3 | 2.0 | 1.2 |
| | 3 | 1.3 | 2.1 | 1.2 |
| | 4 | 1.3 | 2.0 | 1.3 |
| | 5 | 1.0 | 2.0 | 1.3 |
| Present Invention (45 g/cup) | Cycle 1 | 1.4 | 2.1 | 1.2 |
| | 2 | 1.2 | 2.1 | 1.2 |
| | 3 | 1.4 | 2.0 | 1.2 |
| | 4 | 1.6 | 2.1 | 1.4 |
| | 5 | 1.7 | 2.0 | 1.3 |
| Present Invention (25 g/cup) | Cycle 1 | 1.5 | 2.0 | 1.1 |
| | 2 | 1.3 | 2.0 | 1.3 |
| | 3 | 1.5 | 2.0 | 1.4 |

-continued

| | | | |
|---|---|---|---|
| 4 | 1.7 | 2.0 | 1.6 |
| 5 | 1.9 | 2.5 | 1.7 |

The above results illustrate that it is possible to achieve overall efficacy, especially on glassware spotting and filming, comparable to the current high phosphate automatic dishwasher detergents with a formula containing very low phosphates in conjunction with a blend of acrylate homopolymer and maleic/olefin copolymer, sodium bicarbonate and carbonate and sodium citrate. surprisingly, these desirable ratings were made with a composition containing only 1.083 percent ($P_2O_5$) ion.

Also surprising was that comparable efficacy was obtained employing only about 55% of the usage of the high phosphate automatic dishwasher detergent i.e. 25 g/cup as compared to 45 g/cup Cascade.

EXAMPLE II

In this Example another side by side comparison of the preferred embodiment described above was made with Cascade in 200 ppm hardwater using cafeteria soil (aged). In this test soiled tableware from use in a cafeteria was sorted visually so that approximately the same soil load was present for each kind of article comparatively tested. Such soil was primarily a greasy, oily type.

The objective of the modified test procedure was to measure the performance of automatic dishwashing detergents under laboratory conditions for their ability to remove a wide range of different food soils and stains directly from dishes, glassware, utensils, etc. Expert panelists are employed to visually evaluate the relative effectiveness qualitatively. The scales for rating spotting and filming are as set forth above. Food particle ratings are a measure of the frequency of food particles, streaks and stains left on each set of wares. The relative frequency of food particles, streaks and stains left on each set of wares was calculated as follows:

$$\text{Relative Frequency} = \frac{\text{Number of food particles, streaks and/or stains}}{(\text{number of panelists}) \times (\text{number of wares per category})}$$

The scale for stain removal ranges from 0% for no stain removal, to 50% for moderate stain removal and up to 100% for complete stain removal.

The results are as follows:

| Soil | Articles | Rating Present Invention (25 g/cup) | Rating Present Invention (50 g/cup) | Cascade (45 g/cup) |
|---|---|---|---|---|
| Food Particles: | Dinner Plates: | 0.0 | 0.1 | 0.0 |
| | Knives: | 0.0 | 0.0 | 0.0 |
| | Forks: | 0.0 | 0.3 | 0.0 |
| | Spoons: | 0.2 | 0.0 | 0.2 |
| | Salad Bowls: | 0.5 | 0.0 | 0.1 |
| | Soup Bowls: | 0.0 | 0.3 | 0.0 |
| | Tumblers | 0.2 | 0.1 | 0.1 |
| Percent Stain Removal | | 99% | 100% | 100% |

The above evaluation again illustrates that it is possible to achieve overall results, as well as the removal of stubborn soil, to a degree comparable to the current high phosphate automatic dishwasher detergents with a formula containing very low phosphate content. Also again noteworthy were the results when a usage of only 25 g/cup of the product of the present invention was employed.

EXAMPLE III

In this Example a side by side comparison of the above preferred embodiment of this invention was made with a formulation containing no phosphates. Except for the complete absence of phosphates and an additional 0.50 percent by weight of sodium bicarbonate, i.e., a total of 45.90 percent by weight, the formulations were the same.

Glass tumblers were subjected to a testing procedure and comparison similar to that of Example I. The water had a hardness of 300 ppm and the usage was 25 grams per cup. The soil applied was a dried milk/margarine mixture. Each cycle employed an average of 2 glass tumblers. The results, utilizing the Rating Scale set forth above is as follows:

| | Cycle (Run No.) | Average Rating: Tumblers Filming | Average Rating: Tumblers Spotting | Average Rating: Utensils Filming |
|---|---|---|---|---|
| Non-Phosphate Formulation | Cycle 5 (1) | 2.1 | 2.0 | 3.2 |
| | 5 (2) | 1.9 | 2.0 | 4.7 |
| Present Invention | Cycle 5 (1) | 2.2 | 2.0 | 1.6 |
| | 5 (2) | 1.8 | 2.0 | 1.3 |

The above results also illustrate that significant improvement in glassware spotting and filming can be achieved by adding just 1.9 percent by weight tripolyphosphate (1.083 percent by weight ($P_2O_5$) ion) and also achieve parity with high phosphate automatic dishwasher detergents.

EXAMPLE IV

The following ingredients were processed in accordance with the method described hereinlater to produce the preferred embodiment of an automatic dishwasher detergent in accordance with the present invention.

| INGREDIENT | FUNCTION | WEIGHT PERCENT |
|---|---|---|
| Sodium Bicarbonate | Alkalinity | 5.00 |
| Sodium Carbonate (Soda Ash) | Builder, Alkalinity | 24.92 |
| Sodium Tripolyphosphate (Hexahydrate) ($P_2O_5$)* | Builder, Sequestrant | 1.90 (1.08) |
| Accusol 445 ND | Polymer Dispersant | 4.30 |
| Accusol 460 ND | Polymer Dispersant | 1.10 |
| Industrol DW-5 (BASF) | Surfactant | 4.00 |
| Sodium Perborate Monohydrate (DuPont) | Oxygen Bleach | 5.00 |
| Britesil H2O (Sodium Silicate) (PQ Corp.) | Corrosion Inhibitor | 20.00 |
| Sodium Citrate Dihydrate | Complexing Agent | 34.50 |
| Fragrance | Aesthetic | 0.18 |
| TOTAL | | 100.00 |

*Percent by weight expressed as ($P_2O_5$) ion.

The detergent composition was prepared as in the previous Examples.

In order to comparatively test this preferred embodiment of the invention, it was subjected to a side by side evaluation with Cascade® Automatic Dishwasher Detergent. Again, the evaluation of the preferred embodiment of this invention versus Cascade in 300 ppm hard water represented an extremely vigorous evaluation.

| | | Average Rating | | |
|---|---|---|---|---|
| | | Tumblers | | Utensils |
| | | Filming | Spotting | Overall Spotting |
| Cascade | Cycle 1 | 1.3 | 2.0 | 1.3 |
| | 2 | 1.3 | 2.0 | 1.2 |
| | 3 | 1.3 | 2.0 | 1.2 |
| | 4 | 1.3 | 2.0 | 1.3 |
| | 5 | 1.4 | 2.0 | 1.3 |
| Present Invention | Cycle 1 | 1.3 | 2.2 | 1.5 |
| | 2 | 1.3 | 2.0 | 1.7 |
| | 3 | 1.8 | 2.2 | 1.8 |
| | 4 | 1.8 | 2.0 | 1.8 |
| | 5 | 2.0 | 2.0 | 1.8 |

The above results illustrate that it is possible to achieve overall efficacy, especially on glassware spotting and filming, comparable to the current high phosphate automatic dishwasher detergents with a formula containing phosphate at a level as low as 1.0 percent by weight (0.57 percent by weight expressed as ($P_2O_5$) ion) in conjunction with a blend of acrylate homopolymer and maleic/olefin copolymer, sodium citrate, sodium bicarbonate and sodium carbonate. Surprisingly, these desirable ratings were made with a composition containing a low level of phosphates not expected to soften water, let alone water having a hardness as high as 300 ppm.

While this invention has been described with reference to certain specific embodiments, it will be recognized by those skilled in the art that many variations are possible without departing from the scope and spirit of the invention and it will be understood that it is intended to cover all changes and modifications of the invention disclosed herein for the purposes of illustration which do not constitute departures from the spirit and scope of the invention.

What is claimed is:

1. A low-phosphate automatic dishwashing composition comprising from about 2.0 to 50.0 percent by weight of alkali metal carbonate salts such that it contains a weight ratio of about 1:1 to 20:1 carbonate to bicarbonate, from about 2.0 to 60.0 percent by weight of a water-soluble organic complexing agent comprising one or more hydroxycarboxylic acids or the salts thereof, a sufficient amount of an alkaline condensed phosphate salt to provide from about 0.1 to 1.7 percent by weight of ($P_2O_5$) ion, from about 0.5 to 8.0 percent by weight of about a 2:1 to a 6:1 blend of an acrylic polymer comprising a salt or ester of acrylic or methacrylic acid having a molecular weight of between about 1,000 to 25,000, with a copolymer of a substituted or unsubstituted maleic anhydride and lower olefin having a molecular weight of from about 1,000 to 50,000, and from about 0.5 to 8.0 percent by weight of a nonionic surfactant.

2. The composition of claim 1 wherein said composition has a pH of from about 9 to 11.

3. The composition of claim 1 wherein said composition contains up to about 10.0 percent by weight of an oxygen bleach.

4. The composition of claim 1 wherein the hydroxycarboxylic acid or salt thereof comprises citric acid or the salts thereof.

5. The composition of claim 4 wherein said composition contains from about 5.0 to 45.0 percent by weight of said citric acid or salt thereof.

6. The composition of claim 1 wherein the alkaline condensed phosphate salt is sodium or potassium tripolyphosphate, hexametaphosphate or pyrophosphate.

7. The composition of claim 1 wherein the alkali metal carbonate salts contain a weight ratio of about 4:1 to 10:1 carbonate to bicarbonate.

8. The composition of claim 1 wherein the alkali metal carbonate is sodium carbonate, potassium carbonate, or mixtures thereof.

9. The composition of claim 1 wherein the alkali metal bicarbonate is sodium bicarbonate, potassium bicarbonate, or mixtures thereof.

10. The composition of claim 1 wherein the acrylic polymer is an acrylic acid homopolymer having a molecular weight of between about 1,000 to 10,000.

11. The composition of claim 1 wherein the weight ratio of acrylic polymer to maleic/olefin copolymer is between about 3:1 to 5:1.

12. The composition of claim 11 wherein the weight ratio of acrylic polymers to maleic/olefin copolymer is about 4:1.

13. The composition of claim 1 wherein the weight percent of maleic/olefin copolymer in said composition is less than about 1.5 percent by weight.

14. The composition of claim 1 wherein the nonionic surfactant comprises one or more ethoxylated fatty alcohols.

15. The composition of claim 1 wherein said composition contains from about 5.0 to 25.0 percent by weight of an alkali metal silicate corrosion inhibitor.

16. The composition of claim 1 wherein said composition contains up to about 60 percent by weight of an inert diluent.

17. The composition of claim 16 wherein the inert diluent is sodium sulfate.

* * * * *